United States Patent [19]

Kinzel

[11] 4,151,617

[45] May 1, 1979

[54] SWIMMING POOL COVER

[76] Inventor: Augustus B. Kinzel, 1738 Castellana Rd., La Jolla, Calif. 92037

[21] Appl. No.: 887,946

[22] Filed: Mar. 20, 1978

Related U.S. Application Data

[63] Continuation-in-part of Ser. No. 752,729, Dec. 21, 1976, abandoned.

[51] Int. Cl.[2] ..... E04H 3/16; E04H 3/19; E04H 3/18

[52] U.S. Cl. ..... 4/172.14

[58] Field of Search ..... 4/172, 172.12, 172.13, 4/177.14

[56] References Cited

U.S. PATENT DOCUMENTS

| | | | |
|---|---|---|---|
| 2,895,143 | 7/1959 | Seitz | 4/172 |
| 2,958,083 | 11/1960 | Shook et al. | 4/172 |
| 2,970,320 | 2/1961 | Karp | 4/172.13 |
| 2,990,556 | 7/1961 | Bender | 4/172 |
| 3,074,079 | 1/1963 | Isaacson | 4/172 |
| 3,418,667 | 12/1968 | Powlan | 4/172 |
| 3,435,465 | 4/1969 | Formel | 4/172 |
| 3,495,279 | 2/1970 | Regan et al. | 4/172.14 |
| 3,501,783 | 3/1970 | Broadman | 4/172.14 |
| 3,613,125 | 10/1971 | Ivkovich | 4/172.14 |
| 3,613,126 | 10/1971 | Granderath | 4/172.14 |
| 3,683,428 | 8/1972 | Morris | 4/172.14 |
| 3,871,033 | 3/1975 | Bartlett | 4/172.13 |
| 3,927,427 | 12/1975 | Aine | 4/172.14 |

*Primary Examiner*—Richard E. Aegerter
*Assistant Examiner*—John W. Shepperd
*Attorney, Agent, or Firm*—Connolly and Hutz

[57] ABSTRACT

A swimming pool cover includes a plurality of sheets arranged in accordion fashion with one of the sheets being attached to the wall of the pool. Hollow rigid pipes are provided for the sheets whereby the sheets may float when the pipes are filled with air. When the pipes are filled with water, the sheets sink and assume an accordion type arrangement thereby permitting use of the pool.

8 Claims, 6 Drawing Figures

41W
50U
50D
24"
W
50U
41A
24
W
W
50D
40W
24
50D
42
52
50U
41A
Pump
44
W
41W
54
Timer
40A
52
62
56
54
Comp
34
60
Sw

SWIMMING POOL COVER

CROSS-REFERENCE TO RELATED APPLICATION

This application is a continuation-in-part of application Ser. No. 752,729, filed Dec. 21, 1976 now abandoned the details of which are incorporated herein by reference thereto.

BACKGROUND OF THE INVENTION

There is a need for swimming pool covers which are effective in use while having sufficient versatility to meet the needs and requirements of various irregularly shaped pools. Various arrangements exist for covering swimming pools. In my U.S. Pat. No. 3,889,303, for example, I disclose a swimming pool cover which includes a frame shaped to conform to the general configuration of the pool. The frame is covered with a sheet in such a manner that by blowing air under the sheet the entire frame and sheet assembly is lifted to cover the pool. During periods of non-use the air is expelled from beneath the sheet and the assembly sinks to the bottom of the pool.

The arrangement of my earlier patent represents one of the many approaches taken in the art. It is known, for example, to utilize a cover member formed in an accordion type fashion whereupon the cover floats on the water surface during periods of use while the individual segments of the cover assume a vertical accordion type orientation during periods of non-use.

SUMMARY OF THE INVENTION

An object of this invention is to provide an improved swimming pool cover of the accordion type which is effective and reliable in operation.

A further object of this invention is to provide such a swimming pool cover which includes means to assure it is completely spread out during periods of non-use of the pool and one that occupies minimal space during periods of pool use.

A still further object of this invention is to provide such a swimming pool cover which has detachable sections or sheets to facilitate repair or replacement thereof and to permit different sized and shaped sections to be incorporated therein for conforming to irregularities in the shape of the pool.

In accordance with this invention a swimming pool cover includes a plurality of sheets arranged in accordion fashion with one of the sheets being attached to the wall of the pool. Solid rigid pipes are provided for the sheets whereby the sheets may float when the pipes are filled with air and may sink into accordion folds when the pipes are filled with water thereby permitting use of the pool.

In the preferred practice of this invention each sheet has an up-and-down swinging edge and a horizontally sliding edge with the swinging edges being secured to the pipes and with the sliding edges being secured to floating members. The rigid pipes may have vertical tubes to permit water and air to be expelled therefrom in accordance with the type of use of the cover.

In a preferred embodiment of this invention a flexible tube is provided along the length of the cover formed by the individual sheets and the tube is filled with air so as to become rigid and straighten out thus assuring that the individual sheets will assume a flat stretched out condition without any of the sheets being atop each other.

THE DRAWINGS

DETAILED DESCRIPTION

Figure 1:
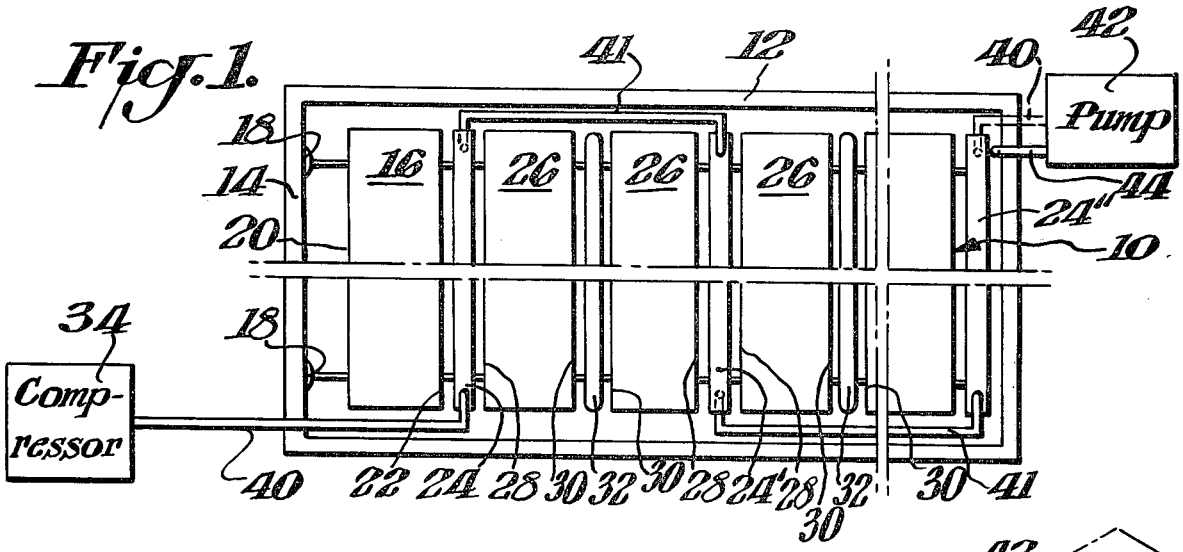
FIG. 1 is a top plan view schematically illustrating a portion of a swimming pool cover in accordance with my invention.
Figure 6:
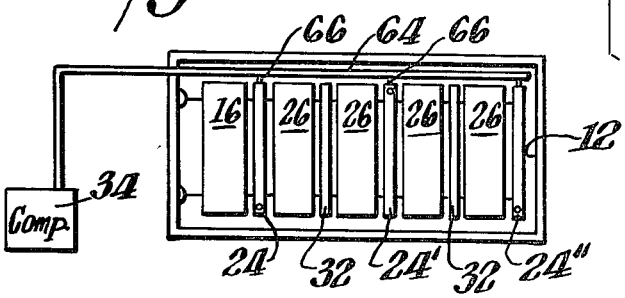
FIG. 6 is a plan view illustrating a further feature of this invention.

FIG. 1 illustrates a portion of a swimming pool cover 10 in accordance with this invention. As indicated therein, the swimming pool 12 would be of any size and shape and would generally include an end wall 14. The swimming pool cover is made in modular form from a plurality of sheets including an anchor sheet 16 disposed at or near a side or end wall 14 and attached thereto in any suitable manner such as by suction cups 18, or by hooks and eyes or by any other fastening devices. Anchor sheet 16 includes an adjacent side edge 20 which is thereby anchored to the wall 14 in a flexible manner and includes a remote side edge 22 parallel to but remote from adjacent edge 20. A hollow rigid pipe 24 is detachably secured in a flexible manner as by, for example, being tied to remote edge 22. When in a flat or horizontal condition (FIGS. 1 and 6) anchor sheet 16 would cover a portion of the length of pool 12.

Cover 10 also includes a plurality of other sheets 26 which may be termed accordion sheets as later described. Each accordion sheet 26 has an edge 28 which may be termed an up-and-down swinging side edge and further has an opposite edge 30 which may be termed a horizontally sliding side edge. Swinging edges 28 are each tied or otherwise secured in a flexible manner to one of the plurality of hollow, non-inflatable, rigid pipes 24, 24', 24'', etc. Each of the horizontally sliding edges 30 is secured to any suitable floating member 32 in a flexible manner to maintain the edge 30 generally at the level of the water but to permit the sheet itself to move to and from horizontal and vertical positions. Thus, as shown in FIG. 1, edges 30, 30 of adjacent sheets are adjacent each other, while edges 28, 28 are likewise adjacent each other. The movement of the sheets is obtained by filling pipes 24, 24', 24'', etc., with air for causing the pipes to float and alternatively with water for causing the pipes to sink.

Figure 3:
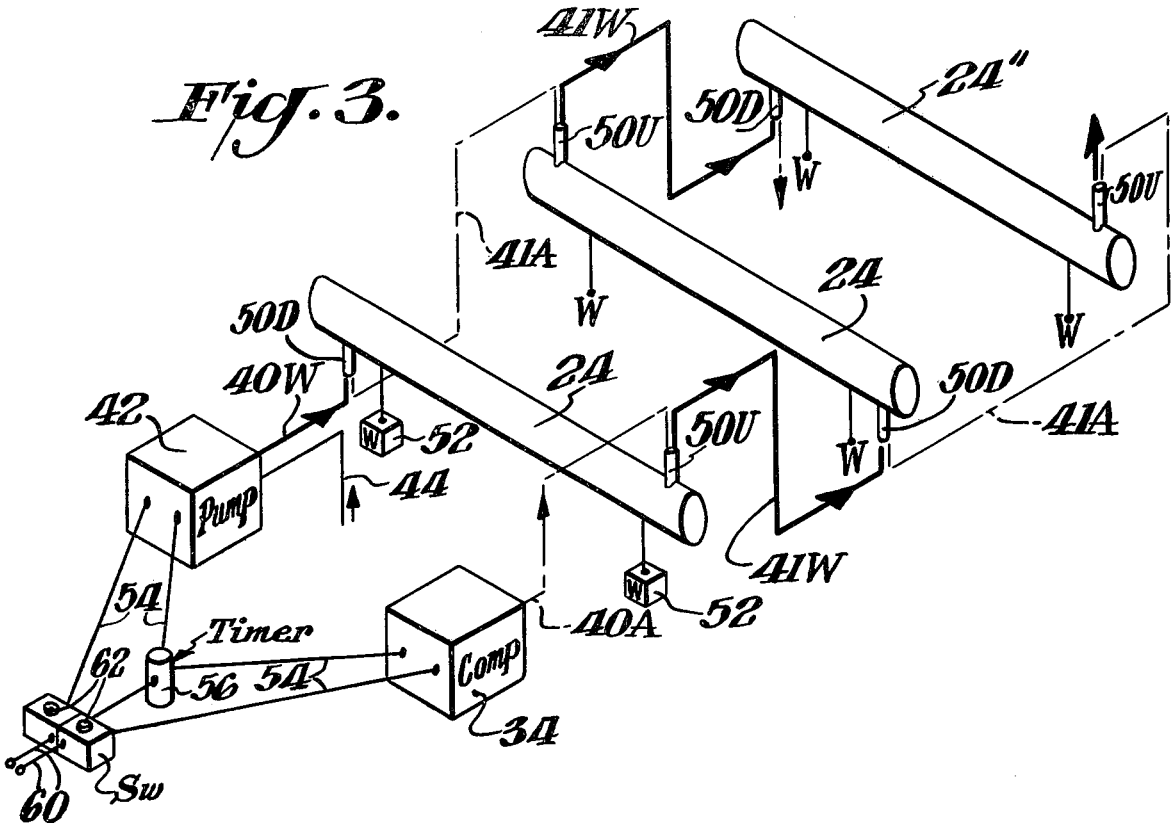
FIG. 3 is a schematic view illustrating the water and air flow in accordance with one embodiment of this invention.

FIG. 3 schematically illustrates one practice of the invention for selectively filling pipes 24 with air and water. As illustrated therein, the solid lines show flow of water when the pump 42 is operative and the phantom lines show flow of air when the compressor 34 is operative. The interconnecting hoses may actually be the same physical hoses and the "A" or "W" designation indicates when that hose is used for conveying air or water. The series type feed arrangement includes separate hoses 40W, 40A for the pump and for the compressor leading directly to the first hollow pipe 24. Each pipe 24, 24', etc. would have sets of vertical vent tubes 50U, 50D, one tube 50U directed upwardly for air and the other tube 50D downwardly for water with suspended weights 52 maintaining the proper vertical orientation. The pump hose 40W would be connected to a downward vent tube 50D in the first pipe 24 and the compressor hose 40A to an upward vent tube 50U in the first pipe 24. The remaining pipes 24', 24'', etc. would be connected to each other in series down the line through these upward and downward vent tubes. Air would ultimately be vented to the atmosphere from an downward tube 50D in the last pipe 24'' and water would be vented into the pool from a upward tube 50U in last pipe 24''.

When the pool is to be used and uncovered the air in tubes 24 is displaced by water. This is done by connecting hoses 40, 41 in a water series flow from pump 42 as indicated in solid in FIG. 3. Water may be supplied from a conventional faucet. In the illustrated practice of the invention, however, pump 42 draws water from the pool itself through hose 44. Water is then pumped through conduit 40W connected to tube 50D and into pipe 24, out of pipe 24 through tube 50U, and down the line through hoses 41 into the various pipes 24', 24'', etc., until the water is discharged from the last vent tube 50U.

Figure 2:
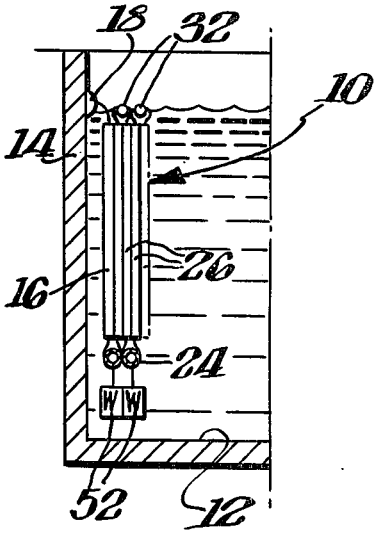
FIG. 2 is a cross-sectional view in elevation of the swimming pool cover shown in FIG. 1 during a period of non-use of the cover.

In order to assure that vent tubes 50 are mounted in a vertical orientation a suitable weight 52 is attached to each tube 24 as illustrated in FIG. 2. Weights 52 may, for example, be sand bags, metal weights or may take any other suitable form.

In the illustrated form of the invention shown in FIG. 3, compressor 34 and pump 42 are controlled by an electrical switch SW which is connected to compressor 34 and pump 42 by suitable electrical wiring 54. The circuitry also includes a conventional timing device 56 for shutting off the compressor and pump after a suitable time period of sufficient duration to allow tubes 24 to be filled with air and water as the case may be. The various components of the assembly including pump 42, compressor 34 and the necessary electrical devices may be conveniently mounted on the deck of the pool with power lines 60 connected to any suitable remotely located outlet. Switch SW may, for example, have a pair of actuating buttons 62 one each for compressor 34 and pump 42. A blue button 62 symbolic of water may be used for pump 42 while a white button symbolic of air may be used for compressor 34.

Sheets 16, 26 may be made of any suitable material such as foamed polyethylene. Similarly, rigid tubes 24 may also be made of any suitable non-inflatable material such as a plastic material or copper which is capable of floating when filled with air.

FIG. 2 illustrates the condition of cover 10 during periods of non-use of the cover. In such condition rigid pipes 24 are filled with water and sink toward the bottom of pool 12. Since edge 20 is anchored to wall 14, sheet 16 rotates downwardly toward the wall 14 until its water filled pipe is in a sunken position thereby disposing sheet 16 generally vertical. The adjacent sheet 26 is likewise pulled toward the wall 14 by its edge 24 swinging downwardly with floating member 32 causing edge 30 to be maintained at the water level. Floating member 32 and its secured edges 30, 30 are moved laterally on the water surface toward wall 14. Thus sheet 26 adjacent anchor sheet 16 is also in a generally vertical position juxtaposed anchor sheet 16. The next sheet 26 undergoes a similar action in that its edge 30 is pulled by floating member 32 horizontally toward wall 14 at the water level while the remote edge 28 is swung downwardly by its sinking pipe 24 causing the next sheet 26 to be generally vertically juxtaposed its adjacent sheet 26. This action continues with the remaining sheets 26 until all of the sheets assume an accordion type position of vertical folds, as illustrated in FIG. 2 occupying a minimal area of the pool 12 adjacent wall 14.

As shown in FIG. 1 a space is provided between each edge 22, 28 and its rigid tube 24 and correspondingly between each edge 30 and its floating member 32. These spaces allow the pool water to flow out of the accordion fold during movement of the sheets. Otherwise water would be trapped in the folds.

Each sheet 16, 26 is detachably secured to the pool wall 14, pipe 24 and floater 32, as the case may be, thus forming a modular assembly. This modular assembly of detachable sheets has the dual advantages of permitting ready replacement of individual sheets should such be necessary for repair purposes and also permitting different sized or shaped sheets to be installed in the assembly so as to conform to any irregularities in the size or shape of the pool and to thus lend itself to a customized type of cover. A typical sheet or module size is 2 feet by 6 feet with the greater length having the edges 28, 30 for example. The actual size would depend on the number of modules or sheets desired and the pool dimensions including depth which would likely vary where the pool has deep and shallow ends. Preferably the sheet size is selected so that in its vertical condition the sheet is barely above the pool bottom. Thus the various sheets may terminate in an inclined plane and may individually be of different dimensions. Moreover, the cover itself may extend from the length or the width of the pool and may be anchored to the end wall itself or merely to the side walls adjacent the end wall.

A significant feature of the inventive arrangement is the provision of means for assuring that the sheets will completely cover the pool when in a flat horizontal condition and that any sheet overlapping which might otherwise occur would be prevented. In this respect when the cover 10 is in the folded accordion position as in FIG. 2 and air then displaces the water in the pipes 24, the pipes 24 begin to float upwards. It would be possible that a pipe would not swing out away from wall 14 sufficiently to clear the sheet above it. This would thereby result in various sheets being overlapped thus preventing the complete spread of the sheets so that they would not cover the entire water surface but rather would be folded horizontally on themselves. This tendency for horizontal folding is prevented by the arrangement best illustrated in FIG. 6. As indicated therein, a flexible tube 64 is provided of a length to extend the entire length of pool 12. Tube 64 is attached to the cover assembly at any suitable locations but preferably is attached to each pipe 24 as indicated by attaching means 66. Similar attaching means may also be provided, if desired, on floating tubes 32 and even to the sheets. Flexible tube 64 is closed at its remote end while its other end is connected to compressor 34. [For the sake of clarity flexible tube 64 is shown only in FIG. 6, while FIG. 6 does not show hose 40 which also leads from compressor 34.] In this manner when air is turned on to fill pipes 24 causing the pipes 24 to rise, air under pressure also fills flexible tube 64 causing flexible tube 64 to straighten out and become rigid. By having tube 64 attached to the outermost pipe 24, there is assurance the straightening action of tube 64 will be transmitted to the outermost sheet. Attaching tube 64 to the remaining pipes also provides lateral restraints to tube 64. In this manner there is also assurance that when tube 64 is filled with air all of the sheets will be spread in a non-overlapping fashion and stretched over the entire length of the pool.

Figure 4:
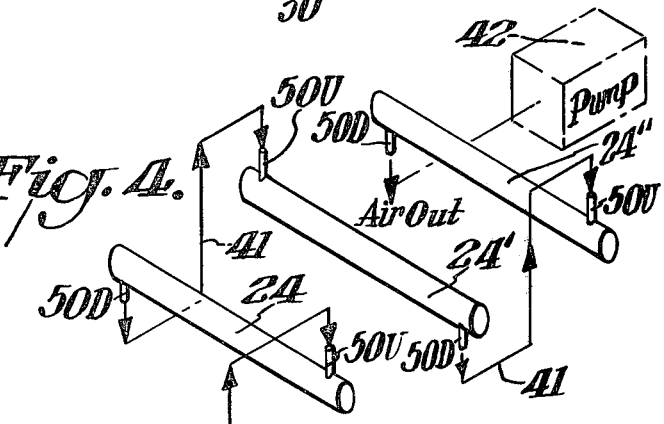
FIGS. 4–5 are schematical views illustrating the air and water flows, respectively, in accordance with another embodiment of this invention.
Figure 5:
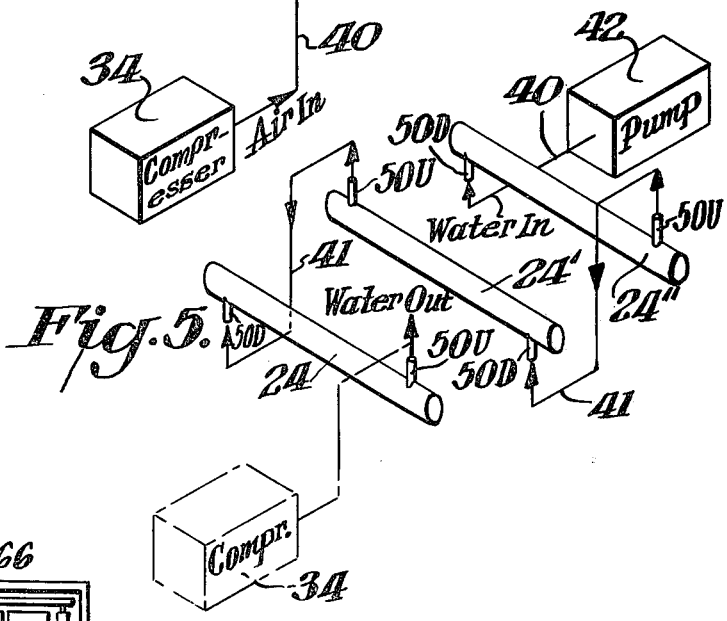

While the arrangement shown schematically in FIG. 3 is advantageous, particularly in having both the pump 42 and compressor 34 at the same end of the pool, there is a disadvantage therewith. This disadvantage is the necessity to disconnect and connect hoses 40, 41 to the pump 42 and compressor 34 series depending on which is to be operative in accordance with the desired condition of the pool cover 10. FIGS. 4–5 (and FIG. 1) schematically show an alternative which avoids this disadvantage. The basic difference between these embodiments is that pump 34 and compressor 42 are mounted at opposite pool ends thus permitting intermediate hoses 41 to remain connected and only hose 40 must be detached and re-connected. FIG. 4, for example, illustrates the flow conditions when air is circulating. As shown therein, hose 40 is connected to compressor 34 (which would also have pipe 64 connected thereto) and to tube 50U. The air ultimately discharges from last rigid pipe 24'' through downward tube 50D. When it is desired to fold cover 10, hose 40 is disconnected from compressor 34 and is connected to pump 42 (which would also have intake pipe 44 connected thereto) and to tube 50D. As shown in FIG. 5 water would ultimately be discharged from first rigid pipe 24 through upward tube 50U.

As should be apparent from the above description, swimming pool cover 10 thus provides an arrangement which lends itself to conforming to any irregularities that may be encountered in the size and shape of various pools. The cover assures a complete covering of the pool during periods of pool non-use while occupying minimum space during periods of pool use. Upon proper hose connection, all that is necessary for operation of cover 10 is the simple actuating of an electrical switch which automatically causes water or air to flow, as the case may be, in accordance with the desired condition of the pool.

What is claimed is:

1. A swimming pool cover comprising an anchor sheet for covering a portion of the length of a swimming pool, said anchor sheet having a longitudinal adjacent side edge for being adjacent the wall of a pool and having a remote side edge remote from and parallel to said adjacent edge, means for flexibly fastening said adjacent edge at the wall of the pool, a hollow rigid pipe flexibly connected to said remote edge of said anchor sheet whereby said remote edge may swing up and down in response to the vertical position of said hollow rigid pipe, an accordion sheet for covering a further portion of the length of the pool, said accordion sheet having an up and down swinging side edge and a horizontally sliding side edge remote from and parallel to said swinging edge, said swinging edge being flexibly connected to said hollow rigid pipe, a rigid floater member for riding at the surface of the water in the pool, said horizontally sliding edge being flexibly connected to said floater member, a plurality of said accordion sheets for covering the remaining portions of the length of the pool, a plurality of said hollow rigid pipes between pairs of said accordion sheets, said hollow rigid pipes being generally parallel to each other in the form of a series of said rigid pipes, a plurality of said floater members between pairs of said accordion sheets, each of said accordion sheets having an up and down swinging edge connected to one of said hollow rigid pipes and having a horizontally sliding edge connected to one of said floater members, means for introducing air into said hollow rigid pipes for causing said hollow rigid pipes to float whereby said sheets assume a flat condition spanning the water, means for expelling the air from said hollow rigid pipes and filling said hollow rigid pipes with water for causing said hollow rigid pipes to sink whereby each of said sheets assumes a vertical condition in an accordion type fashion from said anchor sheet, said hollow rigid pipes having sets of vertical vent tubes, one of said vent tubes on each of said hollow rigid pipes being upwardly directed and the other of said vent tubes being downwardly directed, said means for introducing air including an air compressor connected to the upwardly directed vent tube in one of the end hollow rigid pipes of said series when air is being introduced from said air compressor, said means for expelling air including a water pump connected to the downwardly directed vent tube in one of the end hollow rigid pipes of said series when water is supplied by said pump, said hollow rigid pipes being connected to each other in series down the line by hoses connected from a vent tube on one of said hollow rigid pipes to a vent tube on the adjacent hollow rigid pipe, the downwardly directed vent tube on the end hollow rigid pipe of said series remote from said hollow rigid pipe to which air compressor is connected being open to permit water to vent therefrom when said air compressor is connected to said series of said hollow rigid pipes, the upwardly directed vent tube on the end hollow rigid pipe of said series remote from said hollow rigid pipe to which said pump is connected being open to permit air to vent therefrom when said pump is connected to said series of said hollow rigid pipes, and weighted means on each of said hollow rigid pipes for maintaining said vent tubes vertical.

2. The cover of claim 1 including rigidifying means connected to said sheets along the length of the pool for horizontally separating said sheets from each other when said pipes are filled with air to prevent said sheets from being above each other while in their horizontal condition.

3. The cover of claim 2 wherein said rigidifying means comprises a flexible tube closed at its outer end, said outer end being secured at the outermost accordion sheet most remote from said anchor sheet, and means for filling said flexible tube with air to cause said flexible tube to straighten and rigidify to push said outermost accordion sheet in a direction away from said anchor sheet.

4. The cover of claim 3 wherein said flexible tube is connected to said sheets by being connected to one of said hollow rigid tubes.

5. The cover of claim 4 wherein each of said sheets is connected to its said hollow rigid pipe and said floater member with open spaces provided therebetween to permit water to flow therethrough when said sheets are unfolding from their accordion condition.

6. The cover of claim 5 wherein each of said sheets is detachably mounted to its said floating member and its said hollow rigid pipe to permit replacement thereof for repair purposes and for conforming to irregularities in the shape of the pool.

7. The cover of claim 1 wherein each of said sheets is connected to its said hollow rigid pipe and said floater member with open spaces provided therebetween to permit water to flow therethrough when said sheets are unfolding from their accordion condition.

8. The cover of claim 1 including a hose connected to said pump and leading to the pool whereby the pump may draw its water from the pool.

* * * * *